US007845998B2

(12) United States Patent
Ramachandran et al.

(10) Patent No.: US 7,845,998 B2
(45) Date of Patent: Dec. 7, 2010

(54) SPAR WITH DETACHABLE HULL STRUCTURE

(75) Inventors: Manoj Ramachandran, Houston, TX (US); James O'Sullivan, Houston, TX (US); Anil Sablok, Houston, TX (US); Jang W. Kim, Spring, TX (US)

(73) Assignee: Technip France, Courbevoie (FR)

( * ) Notice: Subject to any disclaimer, the term of this patent is extended or adjusted under 35 U.S.C. 154(b) by 32 days.

(21) Appl. No.: 12/341,706

(22) Filed: Dec. 22, 2008

(65) Prior Publication Data

US 2009/0158987 A1 Jun. 25, 2009

Related U.S. Application Data

(60) Provisional application No. 61/015,898, filed on Dec. 21, 2007.

(51) Int. Cl.
*B63B 22/02* (2006.01)

(52) U.S. Cl. ..... 441/3; 114/230.2

(58) Field of Classification Search ..... 441/3–5; 114/230.2

See application file for complete search history.

(56) References Cited

U.S. PATENT DOCUMENTS 5,941,746 A 8/1999 Isnard et al.
7,197,999 B2 4/2007 Murray
2003/0031517 A1* 2/2003 Wetch ..... 405/205
2006/0177273 A1* 8/2006 Bonnemaire et al. ..... 405/211
2008/0311804 A1* 12/2008 Bauduin et al. ..... 441/23

FOREIGN PATENT DOCUMENTS

WO WO2007/108705 9/2007

OTHER PUBLICATIONS

International Search Report on corresponding PCT application (PCT/US2008/088042) from International Searching Authority (EPO) dated Oct. 6, 2009.

Written Opinion on corresponding PCT application (PCT/US2008/088042) from International Searching Authority (EPO) dated Oct. 6, 2009.

* cited by examiner

*Primary Examiner*—Stephen Avila
(74) *Attorney, Agent, or Firm*—Klein, O'Neill & Singh, LLP

(57) ABSTRACT

A spar-type offshore platform includes a buoyant upper hull structure having a lower end to which is detachably connected a buoyant lower module. A plurality of mooring line assemblies is connected to the lower module, the total weight of the mooring line assemblies being sufficient to sink the lower module. A method of separating the upper hull structure from the lower module includes disconnecting the lower module from the lower end of the upper hull structure, and then allowing the weight of the mooring line assemblies to sink the lower module.

9 Claims, 3 Drawing Sheets

SPAR WITH DETACHABLE HULL STRUCTURE

CROSS-REFERENCE TO RELATED APPLICATION

This application claims the benefit, under 35 U.S.C. §119 (e), of U.S. Provisional Application No. 61/015,898, filed Dec. 21, 2007, the disclosure of which is incorporated herein by reference in its entirety.

FEDERALLY SPONSORED RESEARCH OR DEVELOPMENT

Not Applicable

BACKGROUND

This disclosure relates to offshore platforms for the exploration for, and production of, undersea petroleum deposits, and, in particular, to the various types of platforms genetically known as spars, whether of the classic, truss, or cell spar variety. More specifically, the present invention relates to a spar-type floating platform, of the type having a buoyant upper hull structure and a buoyant lower module that is detachably connected to the upper hull structure and that supports the mooring lines and/or a lower portion of one or more risers when the upper hull structure is detached from the lower module.

The development of sub-sea petroleum and natural gas deposits in Arctic deep water regions presents special challenges for offshore platform designs. Specifically, platforms in these regions must be able to resist local and global loads from ice in addition to loads imposed by wind, waves, and currents. In some cases, a platform must be moved to avoid contact with or collision with sea ice and icebergs.

One type of platform that has become widely used for the development of deep water deposits is the spar. The threat of ice would make it advantageous for the hull of the spar to be detachable from its mooring and riser system to avoid impact from the ice. Also, the staged development of a particular deposit may be facilitated by changing out topside facilities (by the detachment of the upper hull structure) as development progresses. A spar system having a detachable hull structure is disclosed in U.S. Pat. No. 7,197,999, the disclosure of which is incorporated herein by reference in its entirety,

SUMMARY

In a broad aspect, this disclosure relates to a spar-type offshore platform comprising a buoyant upper hull structure having a lower end; a buoyant lower module detachably connected to the lower end of the upper hull structure; and a plurality of mooring line assemblies connected to the lower module, the total weight of the mooring line assemblies being sufficient to sink the lower module. In accordance with this broad aspect, a method of separating the upper hull structure from the lower module includes disconnecting the lower module from the lower end of the upper hull structure, and then allowing the weight of the mooring line assemblies to sink the lower module.

In accordance with a first specific aspect, this disclosure relates to a spar-type offshore platform comprising a buoyant upper hull structure having a lower end; a buoyant lower module detachably connected to the lower end of the upper hull structure; a plurality of mooring line assemblies, each including a main mooring line with first end attachable to a seabed anchor and a second end detachably connected to the upper hull structure; wherein at least one of the mooring line assemblies includes a transverse anchor line connecting the main mooring line to the lower module; wherein the total weight of the mooring line assemblies is sufficient to sink the lower module.

In accordance with a second specific aspect, this disclosure relates to a method of separating an upper hull structure of an offshore floating platform from a buoyant lower module detachably connected to a lower end of the upper hull structure, wherein the upper hull structure is moored to the seabed by a plurality of mooring line assemblies having a total weight that is sufficient to sink the lower module, each of the mooring line assemblies including a main mooring line having a first end detachably connected to the upper hull structure and a second end attached to a seabed anchor, the method comprising (a) connecting at least one of the main mooring lines to the lower module by a transverse anchor line; (b) detaching the first end of each of the main mooring lines from a first position on the upper hull structure and attaching each of the first ends to a lower second position on the upper hull structure so as to slacken the mooring lines; (c) disconnecting the main mooring lines from the upper hull structure so as to transfer the weight of the main mooring lines to the transverse anchor lines; aid (d) disconnecting the lower module from the upper hull structure so as to allow the lower module to sink under the weight of the mooring line assemblies attached to it.

As the lower module sinks, the effective weight of the mooring line assemblies decreases as they fall to and settle on the seabed. When the total effective weight of the mooring line assemblies (including the anchor lines) is equalized by the buoyancy of the lower module, the lower module stops sinking and remains suspended above the seabed in position for re-attachment to the upper hull structure.

In accordance with a third specific aspect, this disclosure relates to a spar-type offshore platform comprising a buoyant upper hull structure having a lower end; a buoyant lower module detachably connected to the lower end of the upper hull structure; a plurality of hull mooring lines, each having a first end attached to a hull mooring line seabed anchor and a second end detachably connected to the upper hull structure; and a plurality of weighted lower module mooring line assemblies, each having a first end connected to the lower module and a second end connected to a lower module mooring line seabed anchor, wherein the weight of the lower module mooring line assemblies is sufficient to sink the lower module.

In accordance with a fourth specific aspect, this disclosure relates to a method of separating an upper hull structure of an offshore floating platform from a buoyant lower module detachably connected to the lower end of the upper hull structure, wherein the upper hull structure is moored to the seabed by a plurality of hull mooring lines detachably connected to the upper hull structure, the method comprising (a) mooring the lower module to the seabed by a plurality of weighted lower module mooring line assemblies, the weight of the lower module mooring line assemblies being sufficient to sink the lower module; (b) detaching the hull mooring lines from the upper hull structure; (c) disconnecting the lower module from the upper hull structure; and (d) sinking the lower module with the weighted lower module mooring line assemblies to separate the lower module from the upper hull structure.

As the lower module sinks, the effective weight of the weighted lower module mooring line assemblies decreases as they fall to the seabed. When the effective weight of the lower module mooring line assemblies is equal to the buoyancy of the lower module, the lower module stops sinking and remains suspended above the seabed in position for re-attachment to the upper hull structure.

DETAILED DESCRIPTION

Figure 1:
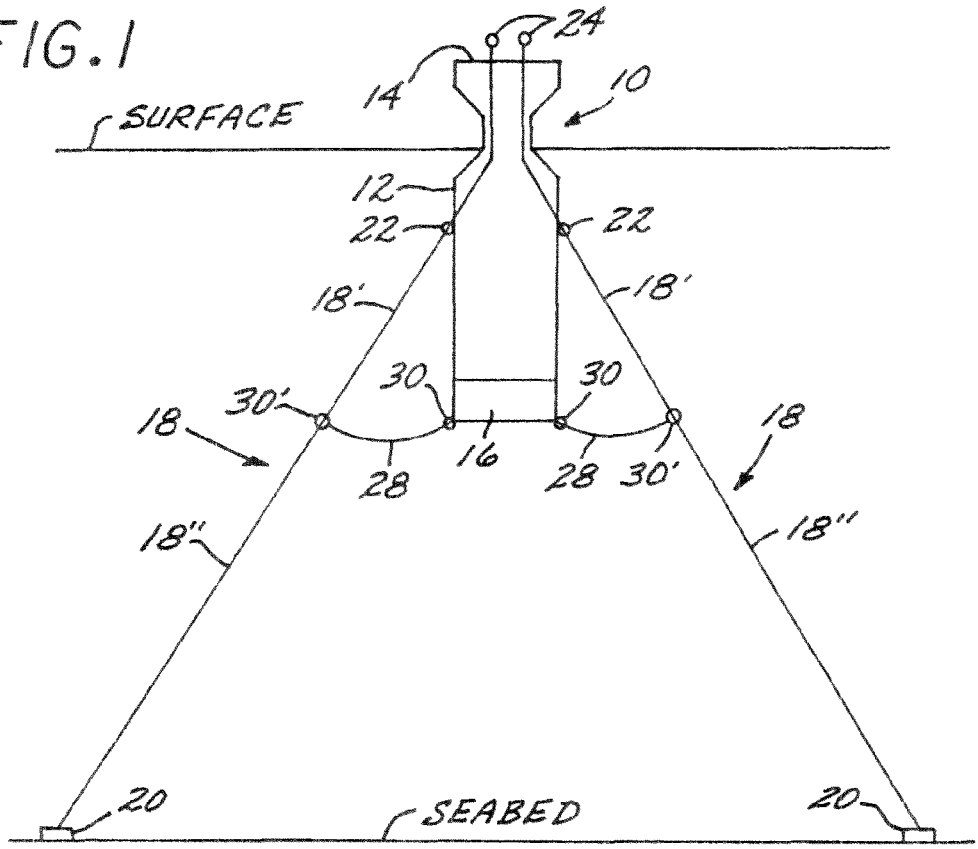
FIGS. 1-3 are semi-schematic elevational views of a spar-type platform with a detachable upper hull structure in accordance with a first embodiment of the present disclosure, showing the steps in the detachment of the upper hull structure from a buoyant lower module.
Figure 2:
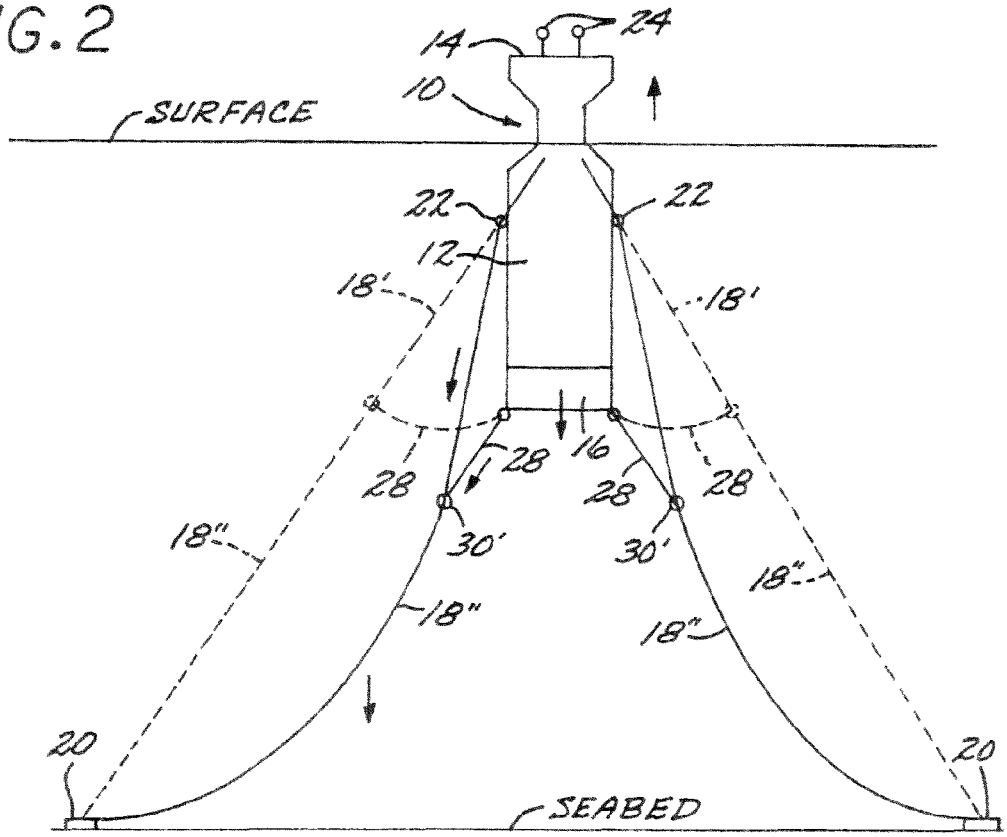
Figure 3:
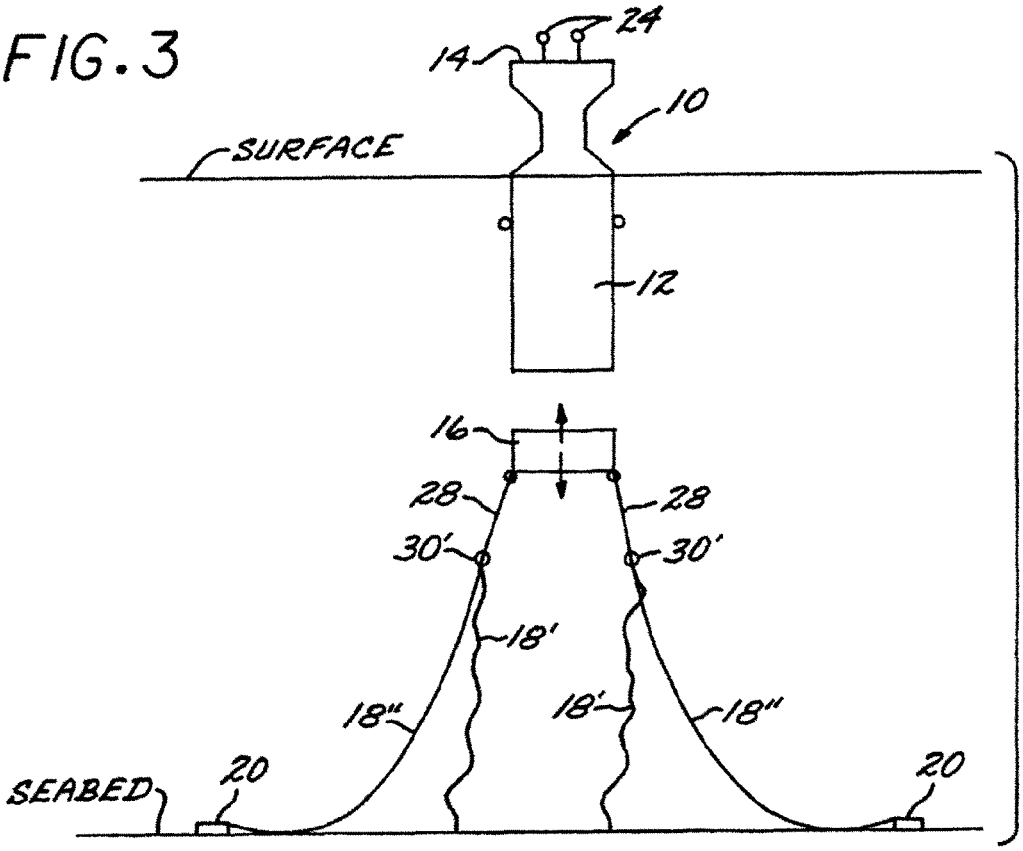

FIGS. 1-3 illustrate a first embodiment of the disclosure. In this embodiment, a spar-type platform 10 includes an upper hull structure 12 that supports a deck 14, and a buoyant lower section or module 16, which may advantageously be configured as a sub-sea mooring buoy (SSMB) or as a keel buoy. The platform 10 may be any spar-type platform, such as, for example, a cell spar, a "classic" spar, or a truss spar. The lower module 16 has a positive buoyancy, and it advantageously has one or more adjustable ballast tanks (not shown) that provide it with variable or adjustable buoyancy.

The upper hull structure 12 and the lower module 16 are detachably connected to each other so that the upper hull structure 12 can be removed from the lower module 16 and relocated, either by towing or under its own power. The lower module 16 is connected to the lower end of the upper hull structure 12 by a coupling/decoupling mechanism or apparatus (not shown), such as, for example, the detachable connection mechanism disclosed in the above-mentioned U.S. Pat. No. 7,197,999. After decoupling and separation, as described below, the lower module 16 may be subsequently retrieved and reconnected to the upper hull structure 12.

A plurality of mooring line assemblies is provided, each of which includes a main mooring line 18, and at least one of which includes a transverse anchor line 28, to be described below. Each of the main mooring lines 18 includes a distal end attachable to a seabed anchor 20. Although only two mooring line assemblies are shown, it is understood that a typical platform will have between four and eight mooring lines, and possibly more. As discussed below, the mooring line assemblies have a total weight that is sufficient to overcome the buoyancy of the lower module 16. (If the platform 10 includes catenary risers, as discussed below with respect to the embodiment of FIGS. 4-6, the total weight of the mooring lines assemblies must be sufficient to overcome the net buoyancy of the lower module 16 with any risers that are coupled to it.) Each of the main mooring lines 18 is advantageously run through the side of the upper hull structure 12, and through a guide element 22 (which may be, for example, a fairleader), and then through one of a plurality of winches 24 located on the deck 14. The main mooring lines 18 may advantageously be secured to the upper hull structure 12 by means of upper chain stoppers or cable locks (not shown), as disclosed, for example, in the above-mentioned U.S. Pat. No. 7,197,999.

Each of the transverse anchor lines 28 has a first end connected to the lower module 16 by first attachment means 30, such as a shackle or coupler, and a second end connected to its associated main mooring line 18 by second attachment means 30' similar to the first. It is preferable, but not necessary, to have a transverse anchor line 28 connecting each of the main mooring lines 18 to the lower module 16, but it is necessary only to have a sufficient number of the main mooring lines 18 so connected to the lower module 16 to perform the upper hull structure separation function described below. The transverse anchor lines 28 have a catenary configuration, whereby the positive buoyancy of the lower module 16 maintains its connection to the upper hull structure 12. Each of the main mooring lines 18 may be understood as comprising an upper mooring line portion 18' above the second anchor line attachment means 30', and a lower mooring line portion 18" below the second anchor line attachment means 30'.

The process of disconnecting and removing the upper hull structure 12 from the lower module 16 is illustrated in FIGS. 2-3. FIG. 2 shows the spar platform 10 with the upper hull structure 12 connected to the lower module 16. At the beginning of the disconnection process, as illustrated in FIG. 2, the main mooring lines 18 are detached from the winches 24, and lowered, using means such as guide lines (not shown), and then locked off at a lower position on the upper hull structure 12, for example at the guide elements 22, thereby slackening the main mooring lines 18. The lower mooring line portions 18" fall as the main mooring lines 18 slacken, so that their weight tends to pull the transverse anchor lines 28 taut, thereby applying a downward force to the lower module 16, against its own buoyancy, away from the upper hull structure 12.

Finally, as shown in FIG. 3, the upper mooring line portions 18' are then disconnected from the upper hull structure 12, so as to transfer the weight of the main mooring lines 18 to the transverse anchor lines 28. The coupling/decoupling mechanism or apparatus is then actuated so as to disconnect the lower module 16 from the upper hull structure 12. The lower module 16, now unsupported by the buoyancy provided by the upper hull structure 12, thus sinks toward the seabed while controlled by, and under the weight of, the mooring line assemblies, thereby separating the lower module 16 from, the upper hull structure 12. The upper hull structure 12, now freed from the seabed anchors 20, floats upward away from the lower module 16. The lower module 16 continues to sink as the effective weight of the mooring line assemblies decreases as they fall to and settle on the seabed. When the total effective weight of the mooring line assemblies 28 is equalized by the buoyancy of the lower module 16, the lower module 16 stops sinking and remains suspended above the seabed in position for re-attachment to the upper hull structure 12.

Reconnection of the upper hull structure 12 to the lower module 16 is performed by positioning the upper hull structure 12 over the submerged lower module 16, and then employing known recovery and re-connection apparatus and methods, such as those disclosed in U.S. Pat. No. 7,197,999.

Figure 4:
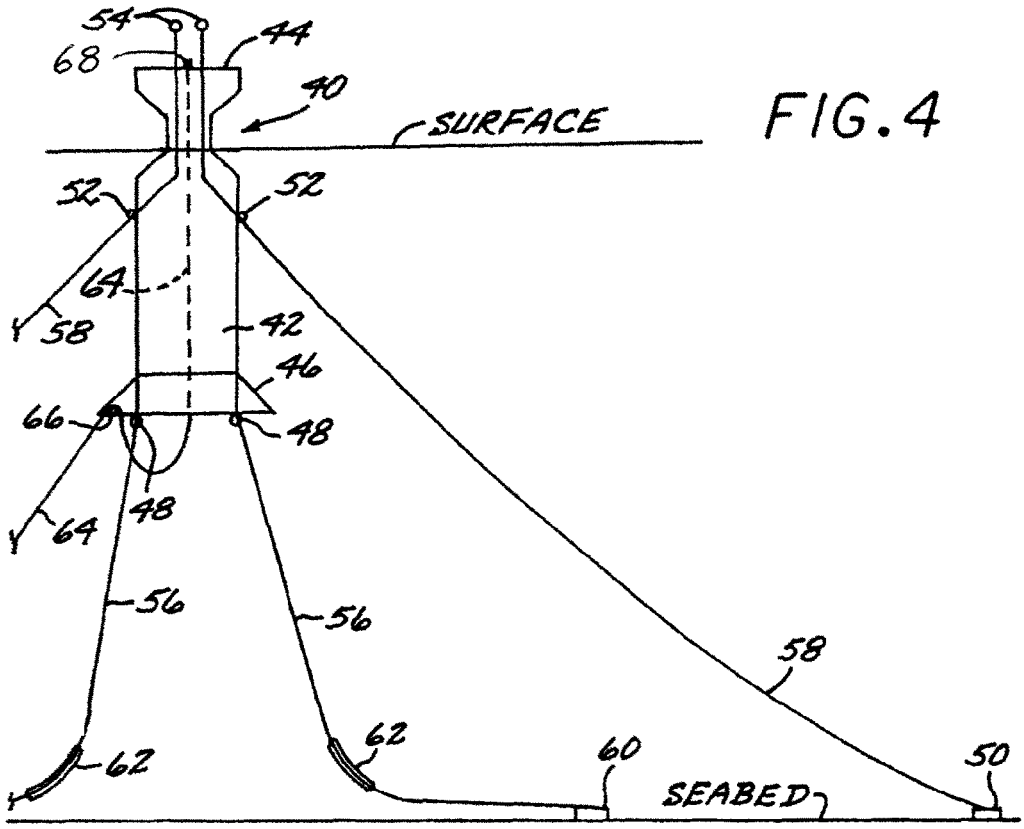
FIGS. 4-6 are semi-schematic elevational views of a spar-type platform with a detachable upper hull structure in accordance with a second embodiment of the present disclosure, showing the steps in the detachment of the upper hull structure from a buoyant lower module.
Figure 5:
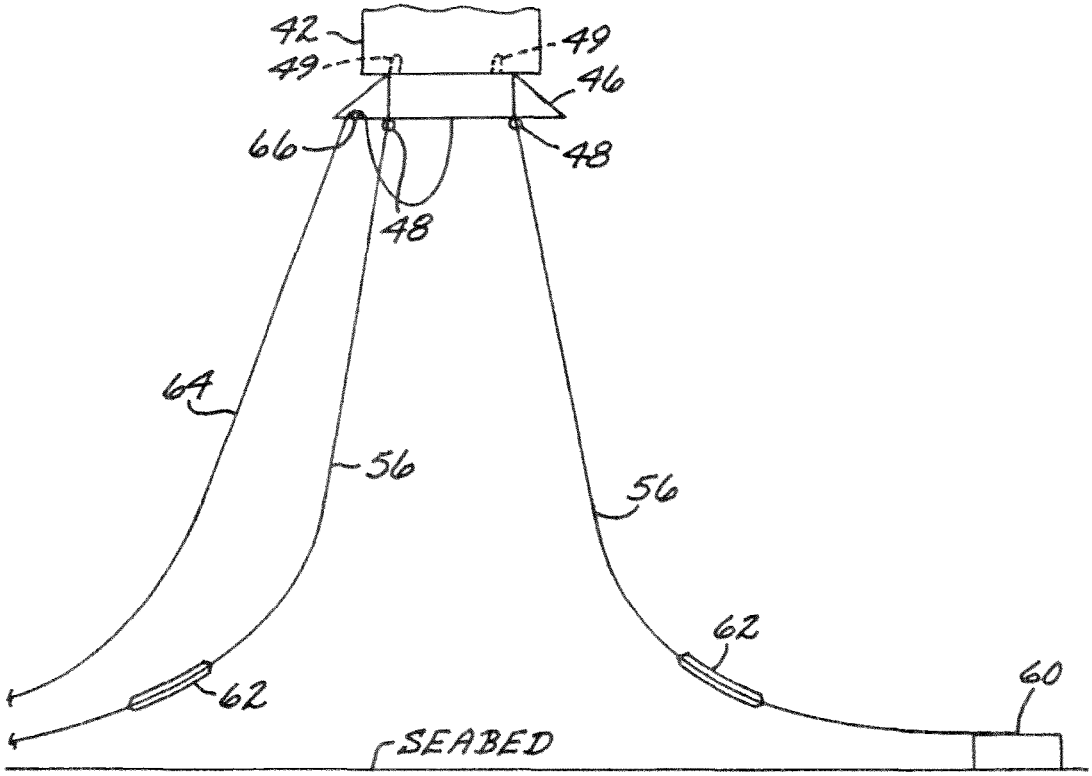
Figure 6:
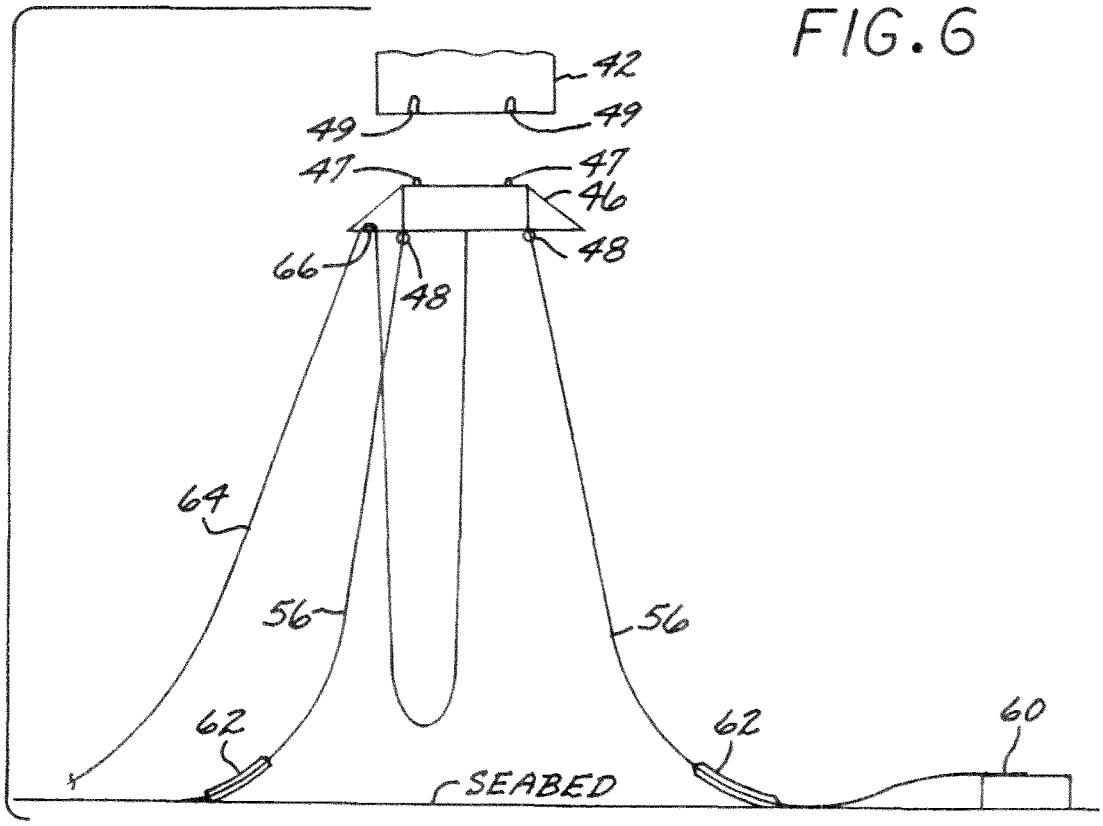

FIGS. 4-6 illustrate another embodiment of the disclosure. In this embodiment, as in the first embodiment described above, a spar-type platform 40 includes an upper hull structure 42 that supports a deck 44, and a buoyant lower section or module 46, which may advantageously be configured as a sub-sea mooring buoy (SSMB) or as a keel buoy. The platform 40 may be any spar-type platform, such as, for example, a cell spar, a "classic" spar, or a truss spar. The lower module 46 has a positive buoyancy, and it advantageously has one or more adjustable ballast tanks (not shown) that provide it with variable or adjustable buoyancy.

The upper hull structure 42 and the lower module 46 are detachably connected to each other so that the upper hull structure 42 can be removed from the lower module 46 and relocated, either by towing or under its own power. The lower module 46 is connected to the lower end of the upper hull structure 42 by a coupling/decoupling mechanism or apparatus, such as, for example, the detachable connection mechanism disclosed in the above-mentioned U.S. Pat. No. 7,197,999, or any other suitable coupling/decoupling mechanism or apparatus known in the art. The coupling/decoupling mechanism is schematically represented in FIGS. 5 and 6 by a plurality of vertical pins 47 on the lower module 46 that are received in mating sockets 49 at the lower end of the upper hull structure 42, but it is understood that this structure is merely representative of a generic coupling/decoupling mechanism or apparatus. After decoupling and separation, as described below, the lower module 46 may be subsequently retrieved and reconnected to the upper hull structure 42.

Each of a plurality of hull mooring lines 58 is anchored in the seabed by a hull mooring anchor 50. Although only two hull mooring lines 58 are shown, it is understood that a typical platform will have between four and eight hull mooring lines, and possibly more. Each of the hull mooring lines 58 is advantageously run through the side of the upper hull structure 42, and through a guide element 52 (which may be, for example, a fairleader), and then through one of a plurality of winches 54 located on the deck 54. The hull mooring lines 58 may advantageously be secured to the upper hull structure 42 by means of upper chain stoppers or cable locks (not shown), as disclosed, for example, in the above-mentioned U.S. Pat. No. 7,197,999.

The lower module 46 Is independently anchored in the seabed by a plurality of lower module mooring line assemblies, each of which includes a lower module mooring line 56 with a proximal or upper end secured to the lower module 46 by conventional means, such as a padeye 48, and a lower or distal end fixed to a lower module mooring anchor 60. Although only two lower module mooring lines 56 are shown, it is understood that a typical commercial embodiment of the lower module mooring system in accordance with this disclosure will have four to eight lower module mooring lines, and perhaps more.

Each of the lower module mooring line assemblies includes a clump weight 62 fixed at an appropriate position on the lower module mooring line 56. Specifically, the position of the clump weight 62 on each of the lower module mooring lines 56 is selected so that when the upper hull structure 42 and the lower module 46 are connected or coupled together, as shown in FIG. 4, the clump weights 62 are suspended above the seabed, thereby applying sufficient tension to the lower module mooring lines 56 to keep them taut. In a preferred embodiment, each of the clump weights 62 may advantageously be a bundle of chains wrapped around over a length of each of the lower module mooring lines 56. Alternatively, the clump weights 62 may be weights (such as chains) that are suspended from each of the lower module mooring lines 56.

The platform 40 typically (but not necessarily) includes one or more catenary risers 64, only one which is shown for clarity. Each of the risers 64 extends from a first end coupled to a wellhead or the like (not shown) on the seabed, upward to a riser guide or chute 66 on the lower module 46, and then upward through the lower module 46 and a centerwell (not shown) in the upper hull structure 42, to a second end detachably coupled to an appropriate conventional riser termination apparatus 68 on the deck 44, as shown in FIG. 4.

The total weight of the lower module mooring lines 56 with the clump weights 62, along with the weight of the risers 64, exceeds the buoyancy of the lower module 46. Put another way, the weight of the clump weights 62 is selected so that the total weight of the lower module mooring lines 56 is sufficient to overcome the net buoyancy of the lower module 46 and the risers 64. Conversely, if the lower module 46 has an adjustable or variable buoyancy, its buoyancy may be appropriately adjusted to achieve the desired relationship with the total weight of the lower module mooring lines 56, clump weights 62, and risers 64.

To decouple and separate the upper hull structure 42 and the lower module 46, the upper ends of the risers 64 are disconnected from their respective termination apparatuses and lowered through the centerwell until they can be secured to the lower module 46 (FIG. 5). The hull mooring lines 58 are then disconnected from the upper hull structure 42, preferably being pulled away from the platform 10 by conventional means such as spring buoys (not shown). The coupling/decoupling mechanism (which may be of any type known in the art, and which is represented generically and schematically by the lower module pins 47 and mating sockets 49 in the upper hull structure 42, as mentioned above) is then actuated so as to disconnect or decouple the upper hull portion 42 and the lower module 46. The upper hull structure 42, freed from the weight of the lower module 46, is buoyed upwardly. At the same time, the weight of the lower module mooring lines 56 with their clump weights 62, along with the weight of the risers 64, pulls the lower module downward toward the seabed, until the clump weights 62 rest on the seabed, at which point the descent of the lower module 46 ceases due to its positive buoyancy.

As in the first embodiment described above, reconnection of the upper hull structure 42 to the lower module 46 is performed by positioning the upper hull structure 42 over the submerged lower module 46, and then employing known recovery and re-connection apparatus and methods, such as those disclosed in U.S. Pat. No. 7,197,999.

It should be understood that the first embodiment of FIGS. 1-3 may typically be employed with catenary risers that would be arranged, deployed, and manipulated in much the same way as described above with reference to the second embodiment of FIGS. 4-6. In that case, the total weight of the risers and the mooring lines would be greater than the buoyancy of the lower module. It is also understood that the second embodiment of FIGS. 4-6 may be used in applications that do not employ catenary risers 64, in which case heavier clump weights and/or different buoyancy values for the lower module may be employed to compensate for the missing weight of the risers.

It should also be understood that the mooring arrangements for the lower module employed in the first and second embodiments described above may be employed together. That is, the lower module may be connected to the hull mooring lines by the transverse anchor lines 28 shown in FIGS. 1-3, and it may also include the lower module mooring lines 56 with the clump weights 62 shown in FIGS. 4-6. The method of separating the upper hull structure from the lower module would be a straightforward combination of the two methods described above with respect to the first and second embodiments.

While preferred embodiments of the disclosure have been described herein, they have been set forth by way of example only, and are meant to encompass a wide range of equivalent structures and methods. It will be appreciated that a number of variations and modifications will suggest themselves to those skilled in the pertinent arts, and that many of the components and mechanisms specifically described in this specification will find equivalents in the applicable technical arts.

Thus, for example, as mentioned above, the apparatus and method described herein will be readily adaptable to the various types of spar-type platforms known in the art, and the modifications necessary or advantageous to accommodate various types of spars will be easily understood by those skilled in the pertinent arts. Also, as will be appreciated by those skilled in the pertinent arts, the term "line" as used in this specification, is meant to encompass a cable, a chain, a steel rope, or any functional equivalent thereof. Likewise, the line holding, guiding, and locking mechanisms described herein may encompass any suitable mechanism available in the art that may accomplish the functions ascribed to these mechanisms. Furthermore, the coupling/decoupling mechanism or apparatus, as discussed above, may be of any suitable type known in the art. These and other modifications and variations should be considered within the spirit and scope of the present disclosure.

What is claimed is:

1. A method of separating an upper hull structure of an offshore floating platform from a buoyant lower module detachably connected to a lower end of the upper hull structure, wherein the upper hull structure is moored to the seabed by a plurality of mooring line assemblies having a total weight sufficient to sink the lower module, each of the mooring line assemblies including a main mooring line having a first end attached to a seabed anchor and a second end detachably connected to the upper hull structure, the method comprising:

(a) providing at least one of the mooring line assemblies with a transverse anchor line connecting the lower module to one of the main mooring lines;

(b) detaching the first end of each of the main mooring lines from a first position on the upper hull structure and attaching each of the first ends to a lower second position on the upper hull structure so as to slacken the main mooring lines;

(c) disconnecting the main mooring lines from the upper hull structure so as to transfer the weight of the main mooring lines to the transverse anchor lines; and (d) disconnecting the lower module from the upper hull structure so as to allow the lower module to sink under the weight of the mooring line assemblies.

2. The method of claim 1, wherein the lower module has an adjustable buoyancy.

3. A spar-type offshore platform, comprising:

a buoyant upper hull structure having a lower end;

a lower module that has a positive buoyancy and that is detachably connected to the lower end of the upper hull structure; and a plurality of mooring line assemblies, each comprising a first portion detachably connected to the upper hull structure, and a second portion connected to the lower module;

wherein the first portion of each of the mooring line assemblies comprises a main mooring line having a first end attachable to a seabed anchor and a second end detachably connected to the upper hull structure;

wherein the second portion of each of the mooring line assemblies comprises a transverse anchor line connecting the main mooring line to the lower module; and wherein the mooring line assemblies have a weight sufficient to overcome the positive buoyancy of the lower module, so as to sink the lower module upon detachment of the first portions of the mooring line assemblies and the lower module from the upper hull structure.

4. The spar-type platform of claim 3, further comprising a winch mechanism attachable to the first portion of each of the mooring line assemblies and operable to lower the first portion of each of the mooring line assemblies relative to the upper hull structure.

5. The spar-type platform of claim 4, further comprising an attachment device positioned on the upper hull structure for attachment of the second end of each of the main mooring lines to the upper hull structure when the first portions of the mooring assemblies have been lowered by the winch mechanism.

6. The spar-type platform of claim 3, wherein at least one of the mooring line assemblies includes a clump weight.

7. The spar-type platform of claim 6, further comprising a catenary riser having a first end on the seabed and a second end detachably coupled to a teimination apparatus in the upper hull structure.

8. The spar-type platform of claim 7, wherein the second end of the riser is attachable to the lower module upon detachment from the termination apparatus.

9. The spar-type offshore platform of any of claims 5-8, 3, and 4, wherein the positive buoyancy of the lower module is adjustable.

* * * * *

UNITED STATES PATENT AND TRADEMARK OFFICE

CERTIFICATE OF CORRECTION

PATENT NO. : 7,845,998 B2
APPLICATION NO. : 12/341706
DATED : December 7, 2010
INVENTOR(S) : Manoj Ramachandran et al.

It is certified that error appears in the above-identified patent and that said Letters Patent is hereby corrected as shown below:

In column 1, line 21, delete “genetically” and insert -- generically --, therefor.

In column 1, line 47, delete “entirety,” and insert -- entirety. --, therefor.

In column 2, line 27, delete “aid” and insert -- and --, therefor.

In column 4, line 42, delete “from,” and insert -- from --, therefor.

In column 5, line 32, delete “Is” and insert -- is --, therefor.

In column 8, line 37, in Claim 7, delete “teimination” and insert -- termination --, therefor.

Signed and Sealed this
Twenty-first Day of June, 2011

David J. Kappos

David J. Kappos
*Director of the United States Patent and Trademark Office*